United States Patent [19]

Guilloteau

[11] Patent Number: 4,511,500

[45] Date of Patent: Apr. 16, 1985

[54] METHOD AND DEVICES FOR PRODUCING EXCHANGES IN RESERVOIRS USED FOR STORING RADIOACTIVE MATERIALS

[75] Inventor: René Guilloteau, Verriers Le Buisson, France

[73] Assignee: Societe Generale pour les Techniques Nouvelles, S.G.N., Montigny-Le-Bretonneux, France

[21] Appl. No.: 465,504

[22] Filed: Feb. 10, 1983

Related U.S. Application Data

[63] Continuation-in-part of Ser. No. 162,947, Jun. 25, 1980, abandoned.

[30] Foreign Application Priority Data

Jul. 2, 1979 [FR] France ..... 79 17159

[51] Int. Cl.[3] ..... G21F 9/12

[52] U.S. Cl. ..... 252/633; 250/506.1; 250/517.1; 376/272

[58] Field of Search ..... 252/633; 376/272; 250/506.1, 507.1, 517.1

[56] References Cited

U.S. PATENT DOCUMENTS

| | | | |
|---|---|---|---|
| 3,236,056 | 2/1966 | Billue . | |
| 3,807,599 | 4/1974 | Schettler et al. | 376/272 |
| 3,888,730 | 6/1975 | Jackson . | |
| 3,972,772 | 8/1976 | Heitmann . | |
| 3,976,541 | 8/1976 | Stiteler et al. . | |
| 4,039,377 | 8/1977 | Andriev et al. . | |
| 4,045,286 | 8/1977 | Blum et al. . | |
| 4,101,377 | 7/1978 | Berniolles et al. . | |
| 4,107,044 | 8/1978 | Levendusky | 252/631 |
| 4,186,051 | 1/1980 | Buscher et al. . | |
| 4,404,165 | 9/1983 | Hesky et al. | 250/506.1 |

*Primary Examiner*—Deborah L. Kyle

*Attorney, Agent, or Firm*—Bell, Seltzer, Park & Gibson

[57] ABSTRACT

In a pool type storage system for storing radioactive waste submerged within water therein, autonomous, dismountable, multi-section exchange units are provided which are submerged directly within the water of the reservoir for effecting heat or ion exchanges on the water without pumping the water from the reservoir.

9 Claims, 10 Drawing Figures

METHOD AND DEVICES FOR PRODUCING EXCHANGES IN RESERVOIRS USED FOR STORING RADIOACTIVE MATERIALS

FIELD OF THE INVENTION

The present application is a continuation-in-part of prior application Ser. No. 162,947, filed June 25, 1980, now abandoned. The present invention relates to a method and devices for producing exchanges in reservoirs used for storing radioactive substances.

BACKGROUND OF THE INVENTION

It is known that radioactive substances (such as for example contaminated wastes or products) have to be stored in pool type, water-filled reservoirs having bottom and side walls and an open top. The water in these reservoirs (which acts as a screen against the ionizing radiations from the said radioactive substances) has to undergo heat exchanges designed to cool the water as well as ion exchanges designed to keep the level of activity of the water low enough to be compatible with the environment. Until now, such exchanges were being carried out in exchangers situated outside the reservoirs.

Such a system (exchanger out of the reservoir) presents the advantage of enabling the use of highly performing sophisticated exchange devices; on the other hand, it has many disadvantages. For example, for cooling the water of the storage reservoir, a pumping installation is generally used to pump in continually the reservoir water and to send it, under high pressure, over a range of plate exchangers supplied under reflux by a high speed flow of cold water; the cooled water, having passed through the range of exchangers, is sent back to the reservoir. Consequently, if highly performing exchangers are used in this system, with use, an increase in the radioactivity of the exchanger is noted, as well as increasing difficulties in the maintenance of the installation. This rapid increase in radioactivity is due to the fact that the water in the reservoirs still contains in suspension colloidal radioactive particles which deposit over the entire piping and exchanging assembly situated outside the pool; therefore it becomes necessary to shield those parts of the installation which have become radioactive. The maintenance problem is due also to the fact that the exchangers used are of light construction, requiring frequent repairs which become rapidly difficult due to the high degree of contamination of the materials.

SUMMARY OF THE INVENTION

It has now been found, and this is precisely the object of the invention, that it is advisable, on the one hand, for the exchanges to be conducted in exchangers directly immersed in the water of the reservoirs and on the other hand, for the exchangers to be of such a design that the flow of reservoir water through said exchangers can be ensured by low or medium pressure devices.

The immediate consequence of using exchanger devices working at low or medium pressure is that the exchangers used are generally less performing than those previously used; another consequence of the fact that the exchangers according to the invention are directly immersed in the reservoirs is that it is necessary to use easily dismountable unitary devices. But despite these apparent disadvantages, it has been found, contrary to the prior art, that the exchangers according to the invention have considerable advantages due in particular to their great adaptability in use.

The present invention therefore relates to a method for producing the necessary exchanges (such as heat and ion exchanges) on the water of reservoirs used for storing radioactive substances, which method consists in carrying out the said exchanges with autonomous units which are dismountable and preferably interchangeable, and are immersed in said reservoirs, and in circulating the water of said reservoirs using known devices working at low or medium pressure.

By autonomous units are meant individual units which are separate, meaning that they are not fixedly connected to the reservoir.

By dismountable units are meant units in which the part or section which carries out the exchange is just placed inside the reservoir and inside elements which are likewise dismountable, the said units being fittable without the need of rivets, bolts, etc. or other such fixed elements.

The units are preferably interchangeable, meaning that the part or section of the unit inside which the exchange occurs, is preferably designed so as to be adaptable to other elements of the unit, whatever the overall function (whether for heat or ion exchanges) of the unit.

The present invention also relates to devices permitting to carry out said method. Said devices (or units) are constituted by:

- a container-base or section (or water-flowing container) provided with at least means for admitting or draining out the reservoir water and, at its upper part, receiving means from the lower part of an exchange part,
- an exchange part or section provided with the adequate inner devices and comprising at its lower and upper portions: water-admitting and draining means, and means to adapt, first, the lower part on the said basic container, and second, the upper part on the pump box, and
- a pump box or section, provided at its lower part with means to adapt it on the upper part of said exchange part, means to admit or to drain out the reservoir water, and with a pump working at low or medium pressure and controlling the flowing into each device, of the reservoir water.

The container-base can be secured to the wall of the reservoir, or rest for example by way of a stable tripod, on the bottom of the reservoir. It is important for the container to be suitably located with respect to the reservoir, so that the exchange part can be positioned on said container-base without any problems. It will however be noted that it is not necessary for the connection between said container and said exchange part to be absolutely tight. In general, the means permitting to receive the lower part of said exchange part is constituted by a simple truncated portion. Care will be taken, when positioning the said container, to place the said water-admitting or draining means at the right level with respect to the bottom of the reservoir, so that the movements of the water will not stir up any of the slimes normally found on the bottom of such reservoirs.

The structure of the exchange part is quite obviously essentially dependent on the type of exchange to be obtained therefrom. But for all cases, said exchange part will be provided at its two ends with means permitting to adapt it, on the one hand, on the upper part of the container-base and, on the other hand, on the lower part of the pump box. If the exchange part is designed for heat exchanges, it will be provided internally with a number of tubes through which, preferably, the reservoir water will flow, and around which preferably, will flow the cooling water, said cooling water to be brought in from the outside by any adequate means such as for example flexible and readily disconnectable pipes. It is also possible to use as cooling liquid for the exchange not cooling water but instead some fluid (non-polluted by the reservoir water) whose change of state can, if necessary, be used to absorb the calories of the reservoir water. If the exchange part is designed for ion exchanges it will be internally provided with one or more beds of ion-exchanging materials, which exchanging materials will, advantageously, be arranged cylindrically and thereafter traversed through inwardly by the reservoir water.

The pump box is essentially composed at its lower part with a device (such as a truncated cone) which cooperates with the upper part of the exchange part, a pump working at low or medium pressure, and obviously a flow of reservoir water which will be circulated by the pump.

Said pump can advantageously be constituted by a screw rotating inside a cylinder and driven by an electric motor situated outside the reservoirs. It may be important for said pump to have a certain height, since it is advantageous to have, on the one hand, the electric motor outside the reservoir, and, on the other hand, the upper part of the "exchange part" of the device at a certain depth below the water level, so that the resulting water layer protects the environment against any radiations which could be due to pollution in said exchange part.

The reservoir water flowing into the device according to the invention can be filtered either when admitted into the device or at the outlet thereof. Said water advantageously flows from the "pump box" towards the "basic container."

BRIEF DESCRIPTION OF THE DRAWINGS

The invention will be more readily understood on reading the following description with reference to the accompanying drawings, in which.

DETAILED DESCRIPTION OF THE INVENTION

Figure 1:
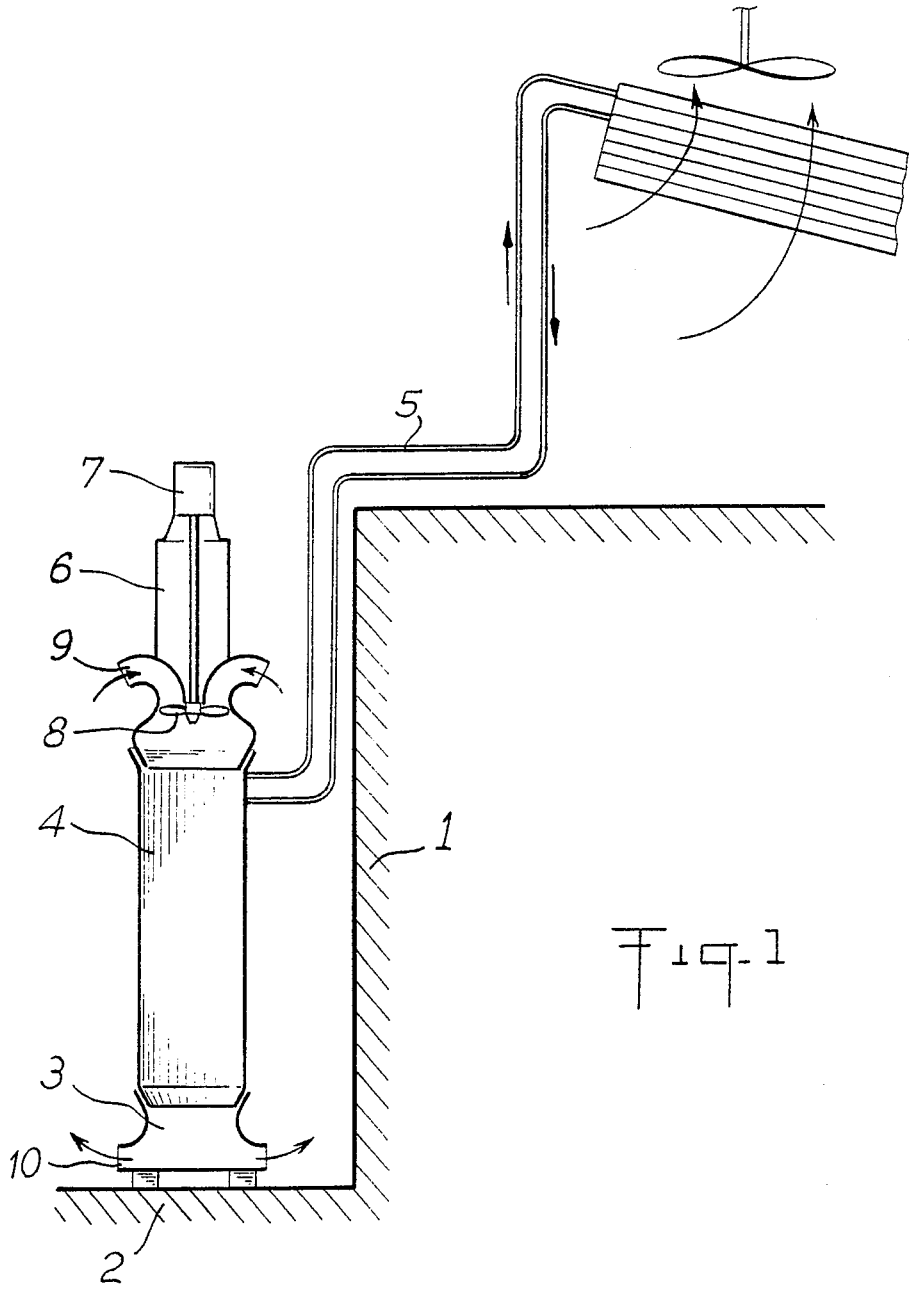
FIG. 1 is a cross-sectional view of the edge of a reservoir for storing radioactive substances in which is immersed a heat exchanging unit according to the invention.

FIG. 1 shows:

at 1, a vertical side wall of the reservoir, generally coated with stainless steel;

at 2, the bottom of said reservoir, also coated with stainless steel;

at 3, a base resting on the bottom of the reservoir, and adapted to receive the exchange part proper of the exchanger; said base generally ends at its upper part into a widened out portion permitting an easier fitting of the exchange part proper; said base is preferably held on the base of the reservoir by means readily remotely-dismantled, such as a bayonet device; moreover said base is provided with apertures 10 for letting out the reservoir water coming out of the exchanger;

at 4, the "exchange part" proper. Said part is for example a tubular heat exchanger or an ion exchanger which comprises one or more exchanging beds; the exchanger illustrated in the figure is a tubular heat exchanger. Said exchange part 4 is fitted over the base 3 by its slightly conical lower portion which corresponds to the widening out portion of the base; the upper end of said "exchange part" is also widened out so as to receive the water-flowing tank. The cooling fluid is brought to that exchange part by means of tubes 5 which are preferably flexible and easily dismountable; said fluid can for example be non-polluted water, the flow of which is controlled by a suitable pump and the cooling of which is controlled by an exchanger (water/air for example) situated outside the reservoir; the figure shows a diagram of such a pump and such an exchanger; but the fluid can also be any known sprayable liquid;

at 6 the tank through which flows the reservoir water; said tank fits into the widened-out portion of the upper part of 4, by its conical lower part. Said tank is essentially constituted by a motor 7 situated outside the reservoir, which motor drives a screw 8 which sucks in the reservoir water through one or more openings 9 and delivers said water through the exchange part 4, up to the aperture 10 provided in the base 3. Other water-flowing devices than that (motor-screw) illustrated in the figure are also suitable; it is however essential, in order to profit from all the advantages of the invention, for the exchange part to cause only a minimum loss of pressure from the reservoir water and that, consequently, flowing devices of the types working at low or medium pressure can be used.

But in all cases, exchange devices should be used wherein the loss of pressure of the reservoir water will be low enough so that the said exchange devices can be fed from flowing devices working at low or medium pressure. For example, in the case where the exchange part is constituted by a bed of ion-exchanging resins, the said bed can advantageously be a sort of a basket of toric-cylindrical shape containing the resin in particle form of suitable granulometry, the said basket being flowed through by the reservoir water from the periphery towards its center.

Figure 2:
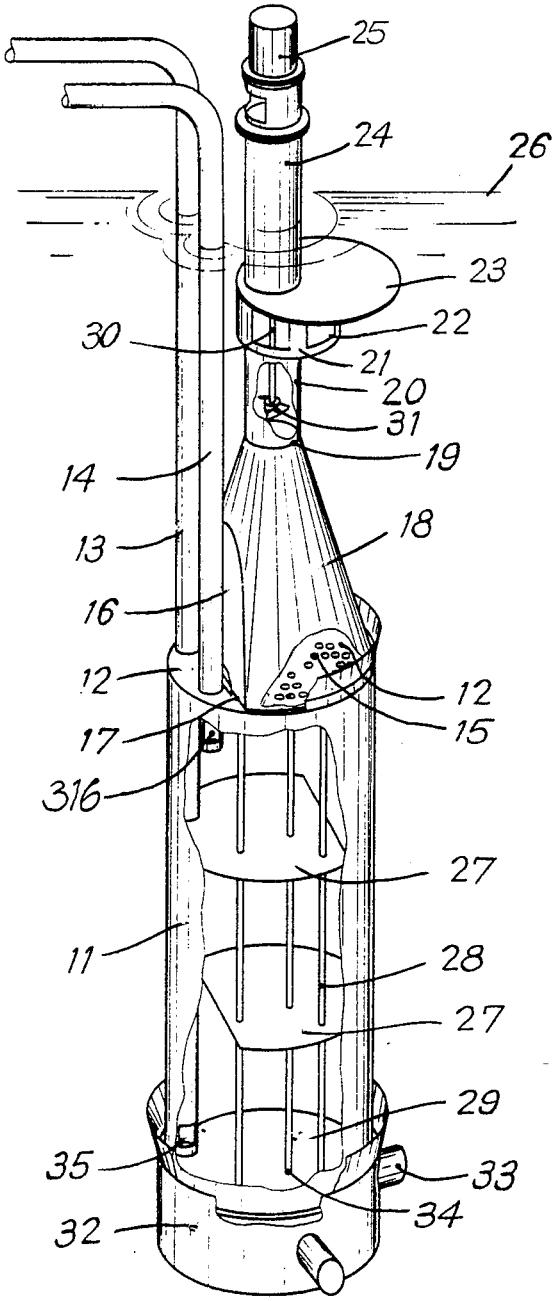
FIG. 2 is a view, sectional in parts, of a heat-exchanging unit according to the invention.

FIG. 2 shows in more detail and partly in sections, a heat-exchanging unit according to the invention.

A cylindrical body 11, of diameter between 50 and 100 cm made from a sheet of stainless steel is closed at its upper part by the plate 12. Said plate is traversed by two vertical pipes 13 and 14 and is also provided with a large number of holes 15 evenly distributed in parallel rows. Over the cylindrical body, above the plate 12, rests a cone 18 with as little play as possible, said cone being provided with a flat truncation 16 parallel to its axis. The small base 19 of the cone is secured tightly (for example by welding) to a cylindrical pipe 20 of diameter between 20 and 30 cm, which is topped by a cylinder-shaped suction box 21 whose axis is shifted to the side opposite the truncation 16 of the cone, the object being to set it apart from said pipes 13 and 14.

The suction box 21 is provided with a plurality of apertures such as 22 to allow the water through. The upper part of said box 21 carries a deflector plate 23 whose function will be explained hereinafter, then a cylindrical pipe 24 having the same axis as the cylindrical body 11 and cone 18, which pipe carries the electric motor 25. The means supplying the electric motor are not shown.

It is noted that the level 26 of the water in the pool is deliberately above the deflector plate 23 and that only the following parts or elements are above the water level:

the upper part (represented horizontally) of the pipes 13 and 14, part of the tube 24, and of course, the motor 25.

The motor drives the axle 30 which is equipped at its end with a screw 31. It is necessary for said screw to be situated between the suction box 21 and the small base 19 of the cone 18.

The exchange part proper is inside the body 11. To this effect, the part of plate 12 which is situated under the truncated cone 18 is provided with holes 15 evenly distributed for example in parallel rows. To obtain a good operation, the number of holes 15 can be set at between 300 and 500, of diameter between 15 and 25 cm. Over each hole, a tube 28 is tightly welded to the plate 12, without projecting from the upper level of said plate. The figure shows only three such tubes 28 (out of a total number equal to the number of holes 15) since these tubes are in actual fact very close together and the drawing would be illegible if they were all represented.

All the tubes 28 go through a succession of horizontal walls 27 which have a double function, the first being to act as deflectors, and the second to support the tubes. It is noted that said walls 27 do not completely close the cylindrical body 11 but that on the contrary they leave a free space for the passage of the water, now on one side, now on the other.

The pipe 13 also traverses some of the horizontal walls 27. The figure only shows two walls 27, but advantageously a larger number, 10 for example, can be placed at regular intervals over the height of the cylindrical body 11.

Said cylindrical body 11 is tightly closed (by welding for example) by a circular plate 29. At each hole 15 of the plate 12 corresponds a hole 34 of same diameter and same geometrical position on the plate 29 with respect to the axis. Each one of tubes 28 therefore goes from one hole 15 to a hole 34 where it is welded (in tight manner) to the plate 29. Pipe 13 on the contrary does not traverse plate 29 and ends with an opening 35 situated above the said plate 29.

The body 11 fits freely into a base container 32 which is provided with outlet tubes 33.

Figure 3:
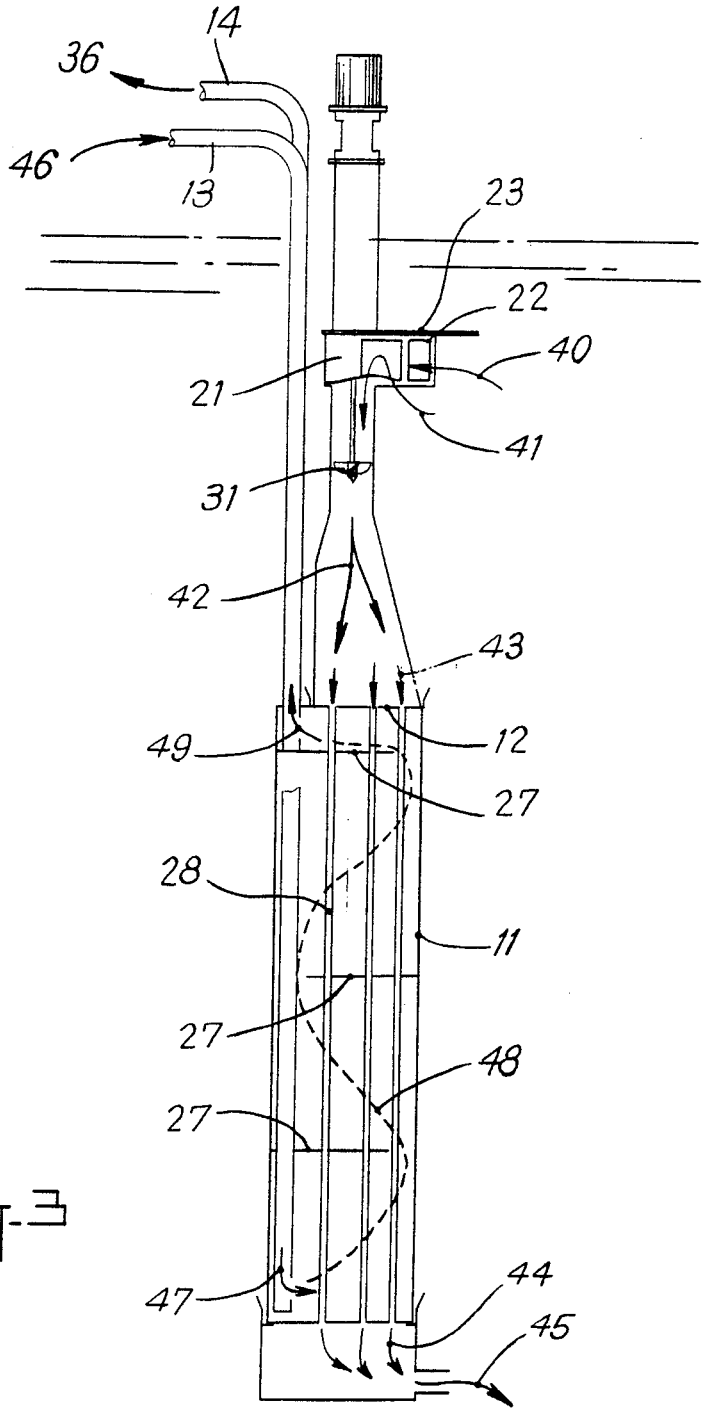
FIG. 3 is a longitudinal cross-section of the heat-exchanging unit shown in FIG. 2, showing how the water flows inside the unit.

It is now explained with reference to FIG. 3, how the heat-exchanger according to the invention works.

The pool water is sucked in by the rotating screw 31 and penetrates into the suction box 21 via orifices 22 in the direction of arrows 40 and 41, then it flows down through the cone along arrows 44 into the container-base and is released along arrow 45 into the reservoir.

A fact to be noted is the advantage presented by the deflector plate 23 which prevents the formation of a vortex or whirl on the water surface with suction of air.

Cold water is admitted into the body through the pipe 13 connected to a pump not shown, and flows in the direction of arrow 46 towards the end of the body where it comes out of the pipe along arrow 47 to spread through the body 11 between the plate 12 and 29, flowing along arrow 48 between the walls 27.

The object of the walls 27 is obviously to lengthen the circuit 48 in order to improve the contact between the water coming from the outside and the tubes 28.

At the end of its flowing path, the water is directed along arrow 49 through the orifice 36 into the pipe 14 and out of the reservoir. Said water has not at any time been in contact with any source of radioactive contamination and can be released out or recycled after normal cooling. It can also be added that, in the event of a leak, it is clean water which will spread into the pool and not pool water which will mix with the clean water.

Indeed, the pressure of the pool water circulated by the screw 31 is very low, between 0.1 and 0.5 bar, compared with the pressure of the pump pumping in the clean water to the pipe 13 (pressure which is between 5 and 10 bars). So that whether the leak is located in a tube 28 or in the body 11, the flow will always stay in the direction of clean water towards pool water.

The design of the apparatus offers an added security in operation: if, for any reason whatsoever, the screw 31 stops rotating, the pool water will continue to flow through the exchanger by thermo-siphon. The pool water which is inside the tubes 28 is cooled by the flow of clean water 48 so that its density increases and said pool water naturally goes down to the bottom and is permanently replaced by hotter superficial water.

The heat energy extracted from the apparatus then is less than when the screw turns but cooling is still ensured partly, this leaving enough time to repair the breakdown.

Figure 4:
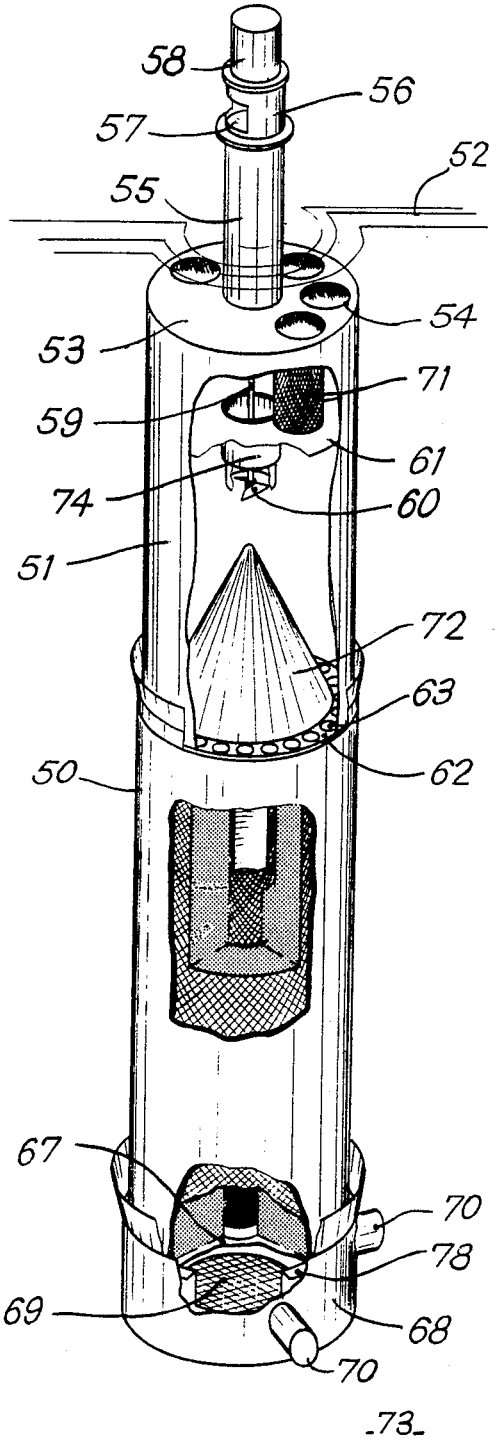
FIG. 4 is a view, sectional in parts, of an ion-exchanging unit according to the invention.

FIG. 4 shows a device according to the invention usable for producing ion exchanges.

A cylindrical body 50 made from a sheet of stainless steel or of cement-asbestos composite is placed vertically in the reservoir; the level of the water is shown in 52, the bottom being in 73. Said body has a diameter between 0.5 and 1 m; it is closed at its lower part by a plate of stainless steel 67 and at its upper part with a plate 62 also in stainless steel, connected in tight manner to the body 50 (for example by welding whenever the body 50 is made of stainless steel). Said plate 62 is provided on its periphery with a series, 20 for example, of holes 63 of diameter between 30 and 60 mm.

Around the said plate 62, the body 50 comprises a widening out portion into which fits the lower part of the flowing tank. Said tank is constituted by a cylindrical part 51 in stainless steel. Inside it is fixed a stainless steel cone 72. The means fastening the cone 72 to the body 51 are not shown for clarity's sake. The wide base of the cone is placed as close as possible to the plate 62; the external diameter of the wide base is such that the holes 63 are not covered by the cone. A wall 61 welded inside the tank divides said tank into two parts.

The upper part of the tank is closed by a welded plate 53 which is provided, on the one hand, with a central hole topped by a tube 55 welded on the plate 53 and on the other hand, with 3 to 5 holes 54 (of diameter between 100 and 200 mm) into which holes are fitted the filters 71.

The tube 55 is topped by the supporting piece 56 provided with the openings 57, and right at the top, by the motor 58. Said motor is supplied by means not shown. The axle 59 of the motor is equipped at its end with a screw 60. Said axle 59 traverses the wall 61 through a sheath 74.

The stainless steel container-base 68 comprises a fine-mesh metallic grid 69, a flange 78 and outlets for the water 70.

The upper part of the said container-base widens into a cone to allow the free introduction therein of the lower part of the cylindrical body 50, so that the weight of the tank 51 is supported by the flange 78.

In FIG. 4, the sectional part shows diagrammatically the disposition of the ion-exchanging resin inside the exchange part of the device.

Figure 5:
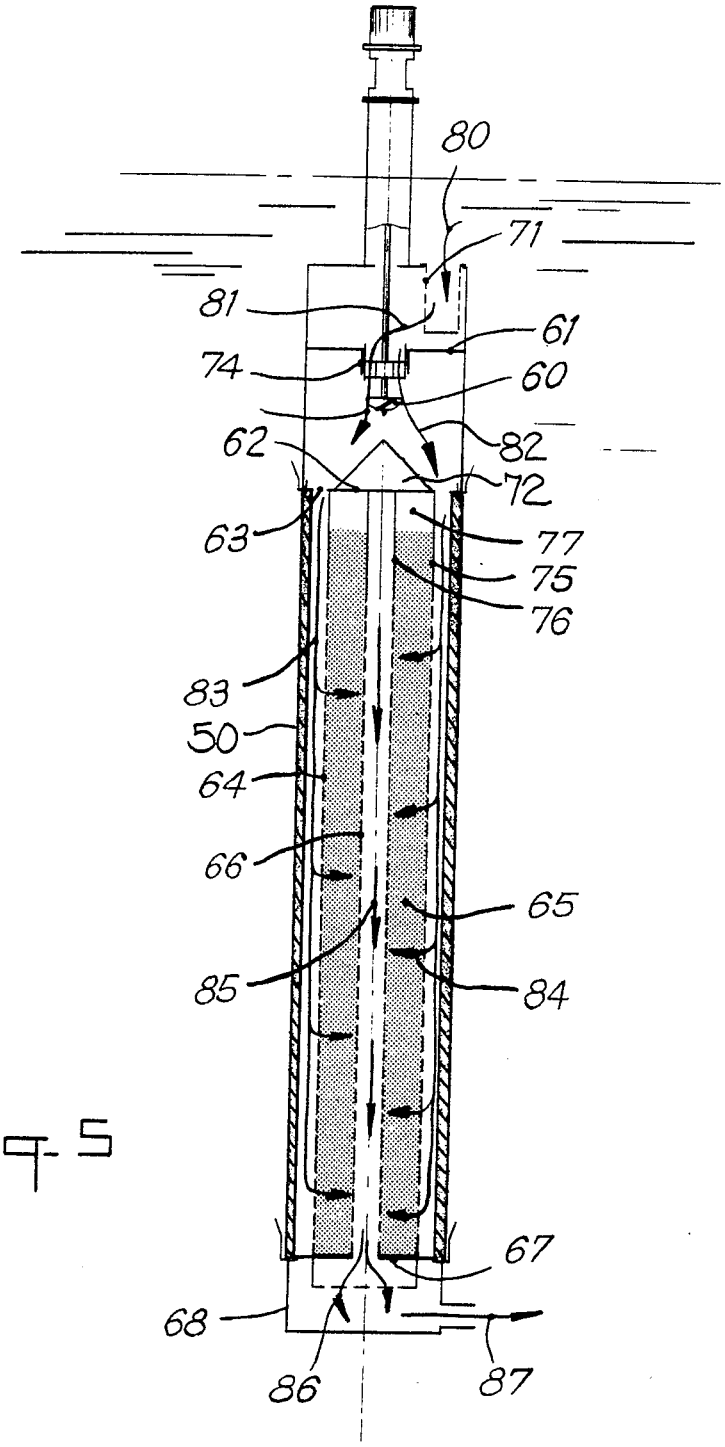
FIG. 5 is a longitudinal section of the ion-exchanging unit of FIG. 4 showing how the water flows inside the unit.

FIG. 5 shows how the exchanger according to FIG. 4 works. Said FIG. 5 clearly shows the annular-shaped layer of resin 65; said resin being placed inside a circular basket comprising an outer sheet 64 and an inner sheet 66. Said basket is placed between the plates 62 and 67; the perforated parts of the basket are covered with a stainless steel sifting gauze with mesh between 100 and 200 micrometers. The said basket is closed at its bottom by a ring-shaped solid plate to which are welded the perforated plates 64 and 66.

The said basket is filled with a mixture of cationic and anionic ion-exchanging resins. The proportion between the two types of resins will be selected for example in relation to the chemical composition of the pool water.

The pool water sucked in by the rotating screw 60, penetrates into the filters 71 along arrow 80, comes out of said filters along arrow 81, flows through the sheath 74 and is distributed laterally along arrow 82 by the cone 72; said water flows through the holes 63 into the annular space provided between the perforated sheet 64 and the body 50 along arrows 83.

The water having reached lower than the non-perforated part, traverses the resin radially as shown by arrows 84, and this, right through the height of the bed of resins until it reaches the central space, arrow 85, after going through the perforated plate 66, and into the base container 68 along arrow 86 to come out into the pool along arrow 87.

It should be noted that, contrary to the heat-exchanger, the ion device cannot work properly if the screw stops rotating.

FIG. 5 shows at the upper part of the basket an empty space 75, 76, 77. The basket is filled with resins and then placed into the body and once the apparatus is completely fitted, it is immersed into the pool.

Most of the resins found on the market settle when operating in the water, and all the more so that the quantity of ions exchanged is high. The unperforated upper part of the basket is designed to prevent the pool water from flowing directly towards the central pipe without flowing through the bed of resins.

The ion-exchanger has been described hereinabove in combination with the filtering device. Although this is not absolutely necessary, we consider this embodiment as the most advantageous according to the invention. Indeed, if non-filtered water is caused to flow through the resins, there is a risk of clogging up first the external sifting gauze, and then the bed of resins, with particles in suspension in the water.

In the same way, the description refers to a stainless steel (with parts in cement-asbestos composite) construction but this is not absolutely necessary and depending on the nature of the fuels stored inside the pool, the user can decide on the best material to use.

The described units have the advantage of being autonomous and independent one from the other. It has been explained that cooling units could work without driving energy, on conditions however that a flow of cooling water (coming from outside the pool) is ensured.

It is obvious that the number of exchangers to be used in one pool will be selected in relation to the fuel load contained in the pool and to the temperature of the water to be observed. It is simple for anyone skilled in the art to regulate the temperature by working the ON and OFF controls of the exchangers.

The same applies to ion exchangers. It has been shown that they do not work when the screw stops rotating. Depending on the results of an analysis of the pollution of the water, the user can decide how many exchangers should be switched off or on.

It is further indicated that other advantages are discovered when carrying out the invention, such as for example:

- no polluted water from the reservoirs flowing out of said reservoirs;
- no need to use pumps with stuffing boxes, or valves delivering highly pressurized water, to ensure the flow of the reservoir water,
- easy mounting and dismantling of the exchange units and autonomy of energy which can be ensured in some case by a mechanical energy recovery system coupled to the water cooling system.

The exchangers work vertically, partly immersed in the reservoir. The fitting-in should preserve the verticality, stability in cases of earth tremors, or shock by a basket of fuels being moved inside the pool, as well as the stable positioning of the different sub-assemblies one with respect to the other.

FIGS. 6 to 10 illustrate the positioning in pools of the devices according to the invention, illustrating, as such, a major advantage in the invention, namely the ready mounting and dismantling of the said devices, hence the possibility of carrying out any types of exchanges and decontaminating any parts of those devices in danger of becoming radioactive.

Figure 6:
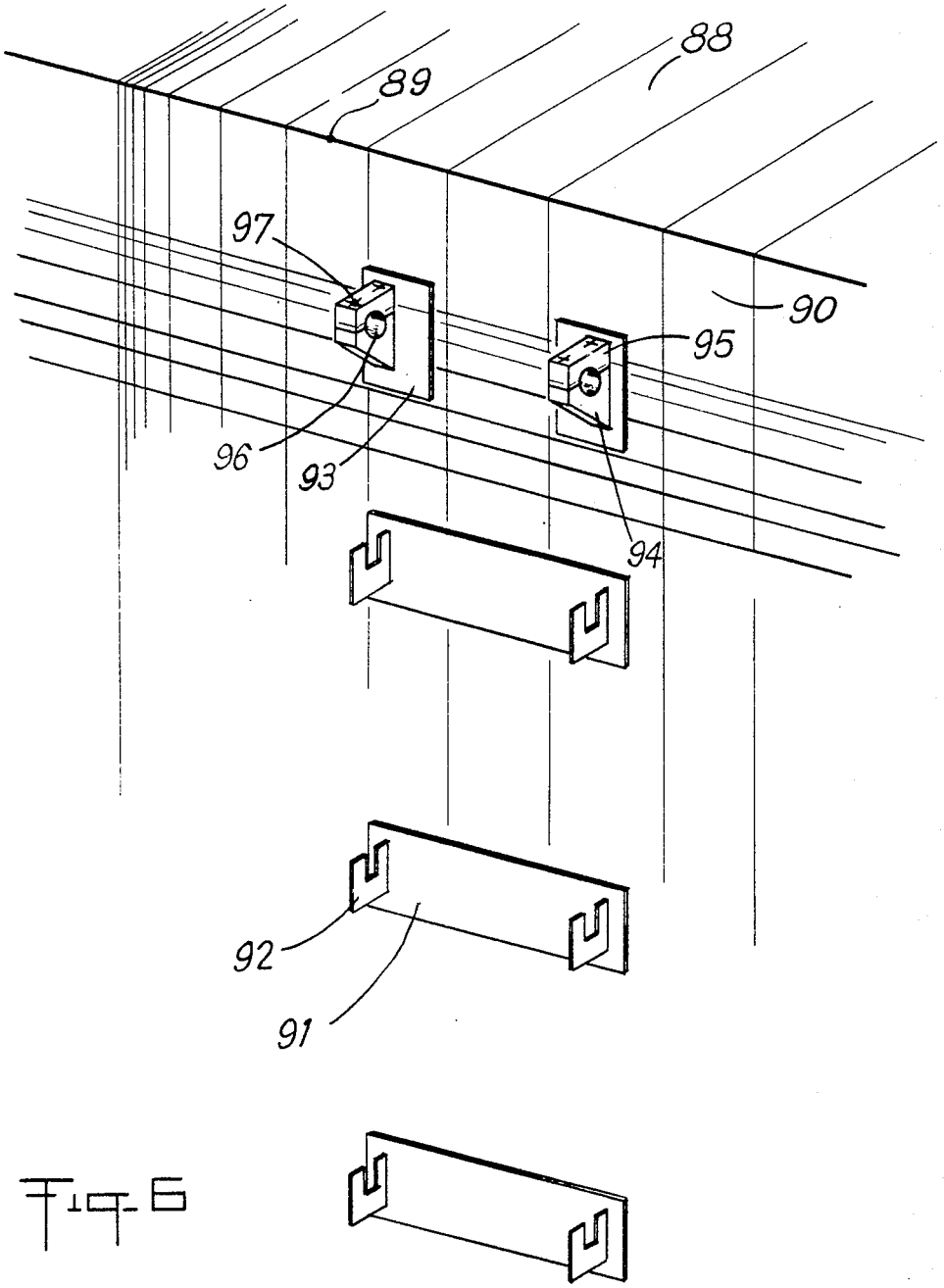
FIGS. 6, 7, 8, 9 and 10 show the preferred means for fitting heat- or ion-exchanging units according to the invention in reservoirs.

FIG. 6 shows in 88 the open part of the reservoir, in 89 the edge of said reservoir and in 90 its vertical wall. On said vertical wall are fixed three rectangular plates 91 secured on pins (for example) anchored in the concrete wall situated behind the wall 90. The securing means are not shown.

Each one of said plates 91 is provided with brackets 92 the open part of which faces upwards. The three plates 91 are aligned one above the other so that the brackets 92 are divided into two straight vertical lines.

The wall 90 comprises above the three said plates 91, two plates 93 (secured in the same way as plates 91). On each plate 93 is welded the lower part 94 of a bearing; the upper part 95 of which is secured by screws 97 on the said lower part 94 so as to provide a cylindrical bore of horizontal axis 96. The two plates are set into place so that the two bearings are in horizontal alignment.

The supporting sub-assembly for positioning the devices according to the invention will now be described with reference to FIG. 7.

The supporting sub-assembly is made in one piece and has the general shape of a ladder on the lower part of which has been fixed the base container. Two vertical uprights 100 (such as for example stainless steel tubes of diameter between 60 and 100 mm), comprise lugs 98 designed to penetrate into the aforedescribed brackets 92. The space situated between the said uprights is ensured by welded cross-pieces 99. On each one of said uprights 100 is also welded a pin 101 designed to penetrate into the bore 96 described hereinabove. A bracket 105 directed frontwards is also welded on each upright.

At the lower part, the supporting sub-assembly is terminated by the container-base joined to each upright by a welded lug 106. Said container-base ends at its upper part into a conical socket 107 into which engages the bottom part of the exchanger body. The same container-base as that 32 shown in FIG. 2 for a heat exchanger and/or that 68 shown in FIG. 4 for an ion-exchanger is also found in this example.

This obviously proves that the same supporting sub-assembly is adaptable to the two types of exchanger (heat or ion).

Figure 8:
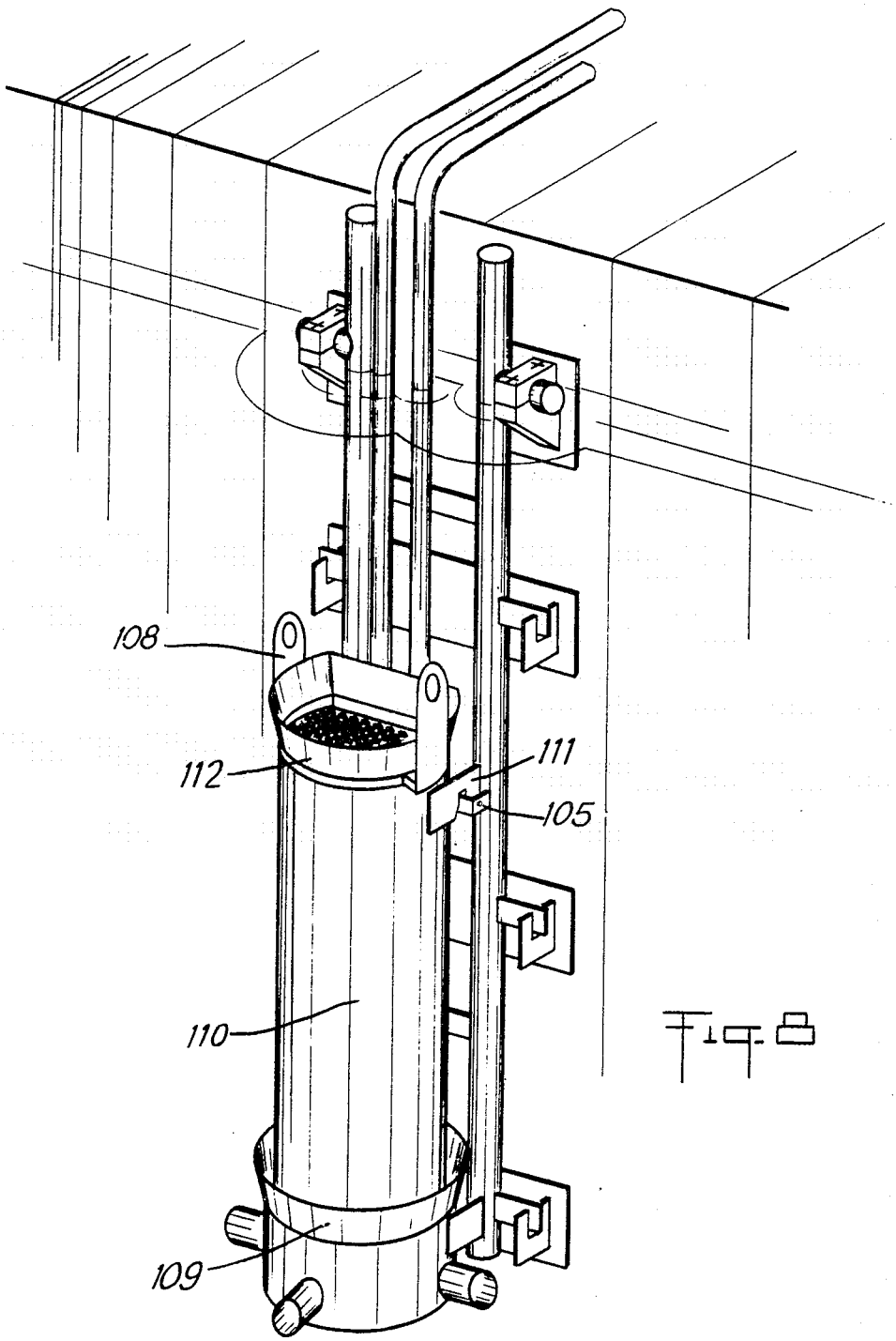

FIG. 8 illustrates the description of the positioning of the body of a heat exchanger on the preceding supporting sub-assembly.

Supporting it with a cable (for example) threaded through the holes of the lugs 108, the body 110 of the exchanger is lowered vertically, so as to engage it into the conical socket of the container-base. It will be noted that said socket is only meant to facilitate the entry of the body into the container-base and that it is not absolutely tight; there is neither any seal or welding joining the body to the said container-base.

The lugs 111 secured on the body 110 penetrate into the brackets 105 described hereinabove. It will be noted that said brackets do not support the weight of the body resting on the container-base. They are merely used to secure stability against any movement.

Figure 9:
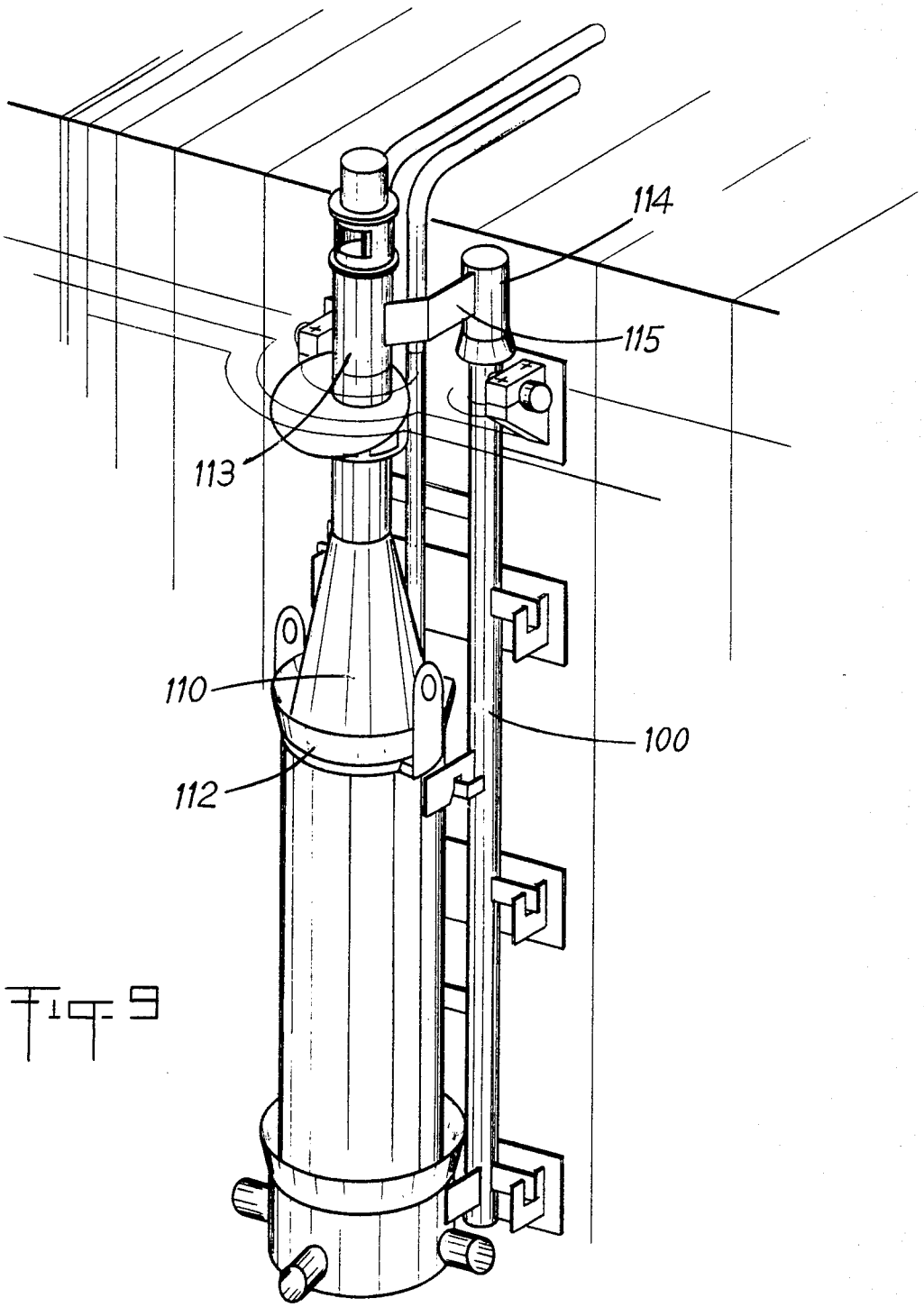

Said body 110 ends at its upper part into a conical socket 112 into which will fit the base of the cone forming the lower end of the pump box placed above it (see FIG. 9).

FIG. 9 shows the heat exchanger mounted up and fitted in. It will be noted that the elements are the same as in FIG. 2, except that the viewing angle is different.

The cylinder 113 (designated as 24 in FIG. 2) comprises two welded lugs 114 each ending into a tube 115 of vertical axis. Said tubes are designed to be fitted over the upper part of the uprights 100 of the supporting sub-assembly. In this position, the lower part (of truncated shape) of the box carrying the pump fits into the truncated part 112 of the exchanger.

Figure 7:
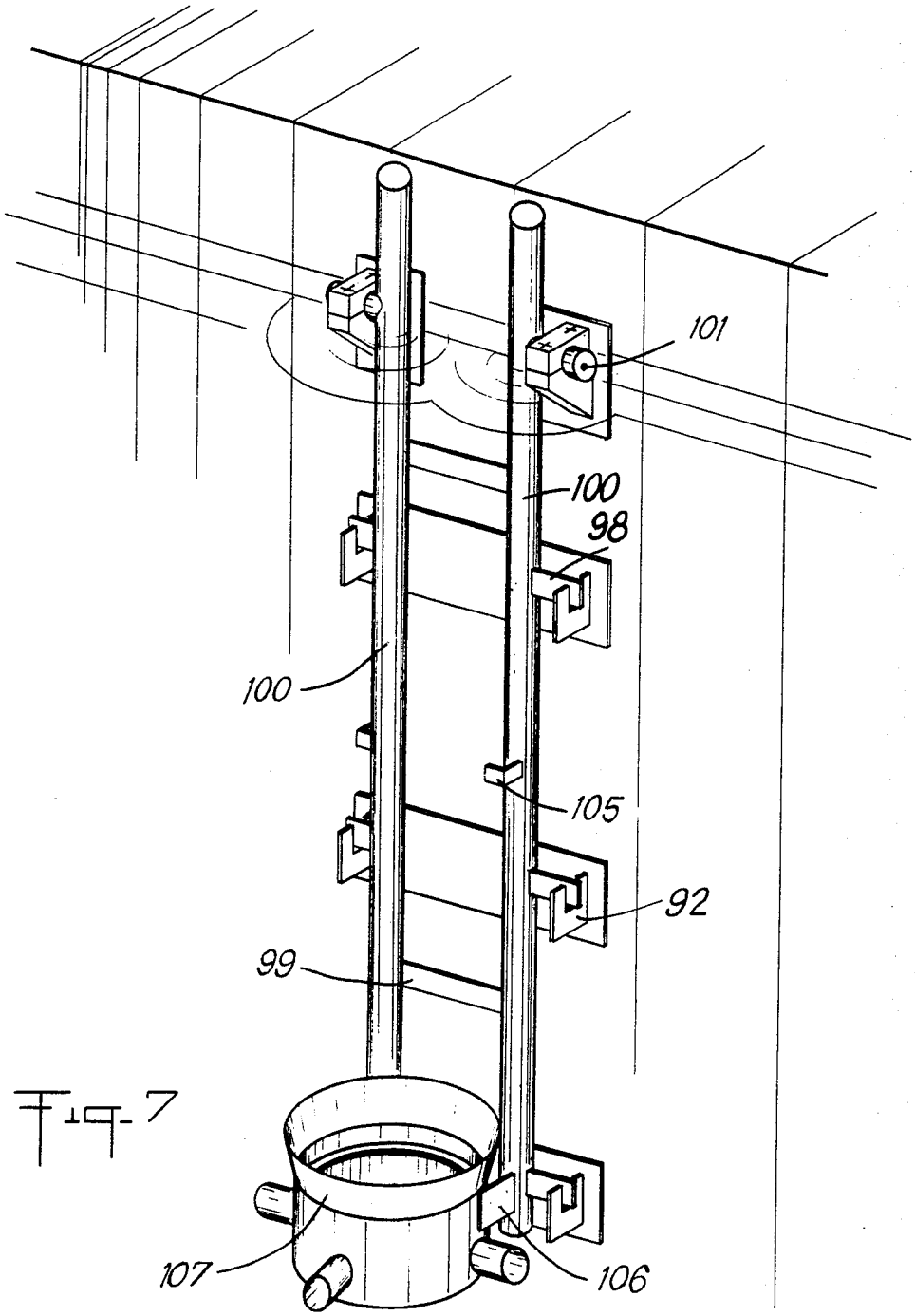

It is important to follow the succession of FIGS. 7, 8 and 9 on which can be seen a complete heat exchanger being constituted by superimposing sub-assemblies: the supporting sub-assembly, the body sub-assembly and the pumping sub-assembly.

Figure 10:
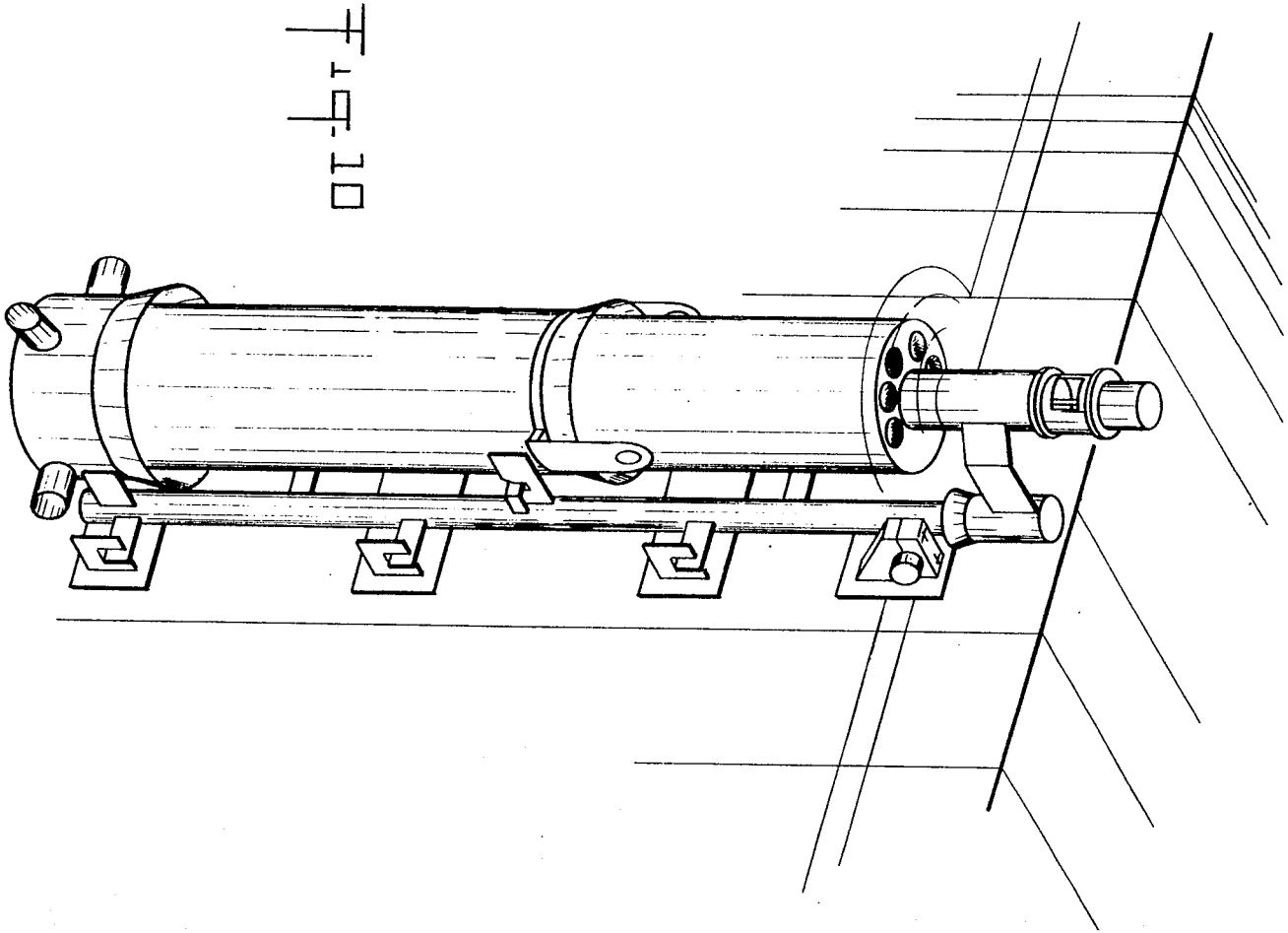

All these details are re-grouped for the ion-exchanger in FIG. 10 where the three sub-assemblies are shown in the assembled position.

Said FIG. 10 also shows, without there being any need for further description, that the ion exchangers, such as illustrated for example in FIG. 4, can be fitted into the reservoir in the same way as the heat exchangers.

It is therefore an obvious advantage for the two types of exchangers to have dimensions and to include devices making them interchangeable.

What is claimed is:

1. In a pool type storage system for radioactive waste including a reservoir having bottom and side walls and an open top, water in said reservoir to a predetermined level along said side walls, and radioactive waste submerged within said water; the combination therewith of means positioned directly within said reservoir and submerged within said water for effecting desired exchanges on said water, said exchange means comprising at least one autonomous, dismountable, multi-section, generally vertically oriented, exchange unit having means for allowing the flow of said water therethrough and including a base section detachably positioned on said bottom wall of said reservoir and having receiving means on the upper end thereof, an exchange section having the lower end thereof detachably positioned on said receiving means of said base section and having a receiving means on the upper end thereof and including means therewithin for effecting an exchange on said water, and a pump section having the lower end thereof detachably positioned on said receiving means of said exchange section and including pump means for at least initiating the flow of said water through said exchange unit.

2. In a storage system, as set forth in claim 1, in which said exchange means comprises at least two of said exchange units, in which said sections of each of said units are interchangeable, and in which said means for effecting an exchange of said exchange section of one of said units comprises means for effecting heat exchanges and said means for effecting an exchange of said exchange section of another of said units comprises means for effecting ion exchanges.

3. In a storage system, as set forth in claim 1 or 2, in which said pump means of said pump section comprises means for pumping said water from said reservoir through said exchange unit at a low pressure of between 0.1 and 0.5 bar.

4. In a storage system, as set forth in claim 3, in which said pump means comprises a driven, rotating screw pump.

5. In a storage system, as set forth in claim 1 or 2, in which at least one of said means for effecting an exchange of said exchange section comprises heat exchanging means including pipes for receiving and passing said water from said reservoir therethrough and means for circulating a cooling fluid around said pipes.

6. In a storage system, as set forth in claim 1 or 2, in which said means for effecting an exchange of said exchange section comprises ion exchange means including a cyclindrical basket and ion exchanging resins within said basket for receiving and passing said water from said reservoir therethrough.

7. In a storage system, as set forth in claim 1 or 2, in which each of said exchange units includes interconnecting and detachable means connected to each of said sections of said exchange unit and to said side wall of said reservoir to permit easy mounting and dismounting of said exchange units within said reservoir.

8. A process for effecting exchanges on water in a pool type reservoir having bottom and side walls and an open top for storing radioactive waste which eliminates the prior necessity of pumping the water out of the reservoir during such process; said process comprising the steps of providing at least one autonomous, dismountable, multisection, exchange unit directly within the water of the reservoir, and causing the water in the reservoir to flow through each of the exchange units without leaving the reservoir while effecting the exchanges on the water.

9. A process, as set forth in claim 8, wherein at least two of the exchange units are provided, and while providing at least one of the exchange units with a section therewithin for effecting a heat exchange on the water and at least one of the exchange units with means therewithin for effecting an ion exchange on the water, and wherein the sections of each of the exchange units are interchangeable.

* * * * *